US007994889B2

(12) United States Patent
Okabe et al.

(10) Patent No.: US 7,994,889 B2
(45) Date of Patent: Aug. 9, 2011

(54) MULTILAYER INDUCTOR

(75) Inventors: Kenji Okabe, Gunma (JP); Kazuhiko Nakamura, Gunma (JP); Toshifumi Kawata, Gunma (JP); Yoshikazu Maruyama, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 853 days.

(21) Appl. No.: 11/755,612

(22) Filed: May 30, 2007

(65) Prior Publication Data

US 2008/0012679 A1 Jan. 17, 2008

(30) Foreign Application Priority Data

Jun. 1, 2006 (JP) ..... 2006-178724
Jun. 1, 2006 (JP) ..... 2006-178730

(51) Int. Cl.
*H01F 5/00* (2006.01)

(52) U.S. Cl. ..... 336/200

(58) Field of Classification Search ..... 336/65, 336/83, 200, 206–208, 232–234
See application file for complete search history.

(56) References Cited

U.S. PATENT DOCUMENTS 6,008,151 A * 12/1999 Sasaki et al. ..... 501/17
7,579,937 B2 * 8/2009 Arata et al. ..... 336/200
7,605,682 B2 * 10/2009 Nakao et al. ..... 336/200
7,817,007 B2 * 10/2010 Lee et al. ..... 336/200
2009/0051476 A1 2/2009 Tada et al.

FOREIGN PATENT DOCUMENTS

JP 56-155516 12/1981
JP 1-197245 8/1989
JP 2006-216916 A 8/2006
WO WO2007/088914 A 8/2007

* cited by examiner

*Primary Examiner* — Tuyen Nguyen
(74) *Attorney, Agent, or Firm* — Law Office of Katsuhiro Arai

(57) ABSTRACT

A multilayer inductor having a uniformly improved direct current superposition property and an increased inductance value is disclosed. The multilayer inductor contains a laminate of a plurality of first insulating layers and a plurality of conductive layers, and the conductive layers and through hole conductors are connected to form a helical coil in the laminate. A second insulating layer which has a magnetic permeability lower than those of the first insulating layers is disposed such that it crosses an inner magnetic path of the helical coil, and a margin of the second insulating layer overlaps with the conductive layer in the stacking direction and is in contact with the conductive layer in the overlap portion. The magnetic flux density in the laminate is likely to be highest in the overlap portion, and thus, the highest-density magnetic flux passes through the second insulating layer inevitably, whereby the direct current superposition property can be uniformly improved.

9 Claims, 8 Drawing Sheets

PRIOR ART

MULTILAYER INDUCTOR

BACKGROUND OF THE INVENTION

1. Field of the Invention

The present invention relates to a multilayer inductor.

2. Description of the Related Technology

Multilayer inductors contain magnetic ceramic layers and conductive layers, which are stacked to form a helical conductive coil in the magnetic ceramic material. When a direct current is applied to a multilayer inductor at a certain level, the inductance of the multilayer inductor is reduced due to magnetic saturation. This phenomenon can be improved by modifying a closed magnetic path type multilayer inductor into an open magnetic path type, specifically by, as shown in FIG. 17, placing a nonmagnetic insulating layer 103 between magnetic layers 101 in a laminate as described in JP-A-56-155516.

Further, a method of improving a direct current superposition property by, as shown in FIG. 18, placing a nonmagnetic insulating ceramic 203 on at least a part of a magnetic ceramic 201 in a coil 202 is proposed in JP-A-11-97245.

However, a multilayer inductor according to JP-A-56-155516, which contains the nonmagnetic insulating layer between the magnetic layers, is disadvantageous in that the nonmagnetic insulating layer separates the magnetic path inside or outside the multilayer inductor, to greatly reduce the inductance value. In an inductor according to JP-A-11-97245, which contains the nonmagnetic insulating ceramic on at least a part of the magnetic ceramic in the coil, the magnetic flux density is higher in a contact region of a conductive layer forming the coil and the nonmagnetic insulating ceramic than at the center of a magnetic ceramic region surrounded by the coil. In a case where the nonmagnetic insulating ceramic has a small thickness, the conductive layer forming the coil is in unstable contact with the nonmagnetic insulating ceramic, whereby the nonmagnetic insulating ceramic can prevent the passing of the magnetic flux only nonuniformly. Thus, when a direct current is applied to the inductor, the inductance value is rapidly reduced without improving the direct current superposition property in 10 to 30% of such inductors. On the other hand, in a case where the nonmagnetic insulating ceramic has a large thickness to prevent the nonuniformity, the nonmagnetic insulating ceramic separates the magnetic path of the multilayer inductor to greatly reduce the inductance value, as with JP-A-56-155516.

SUMMARY OF CERTAIN INVENTIVE ASPECTS

Certain inventive aspects provide a multilayer inductor having a uniformly improved direct current superposition property and a high inductance value.

In one inventive aspect, there is provided a multilayer inductor comprising a laminate containing a plurality of first insulating layers and a plurality of strip-shaped conductive layers formed thereon, the first insulating layers comprising a magnetic material, and the conductive layers being connected to form a helical coil, wherein a second insulating layer having a magnetic permeability lower than those of the first insulating layers is disposed such that the second insulating layer crosses one of an inner magnetic path and an outer magnetic path of the helical coil, and at least a part of a margin of the second insulating layer overlaps with the conductive layer in the stacking direction, and the second insulating layer is in contact with the conductive layer in the overlap portion.

It is clear from a cross-sectional view to be hereinafter described that the multilayer inductor according to one inventive aspect is different from the laminate of JP-A-56-155516, which contains the nonmagnetic insulating layer 103 placed over the magnetic layers 101.

Magnetic saturation is most likely to be caused around a conductive layer, and is less likely to be caused in a part farther from the conductive layer. In a case where the magnetic saturation is not prevented around the conductive layer under an increased direct current, properties of a multilayer inductor are deteriorated. Further, also in a case where a low-magnetic permeability insulating layer is placed in a part farther from the conductive layer, the inductance is deteriorated.

In one aspect, the magnetic saturation around the conductive layers can be reliably prevented, the direct current superposition property can be uniformly improved, and the inductance can be increased.

In one embodiment of the invention, the second insulating layer is in contact with the conductive layer in the surface direction and the thickness direction.

In the multilayer inductor, a plurality of the first insulating layers comprising a magnetic material and a plurality of the conductive layers are stacked to form the laminate, the helical coil is formed by connecting the conductive layers, and the second insulating layer having a magnetic permeability lower than those of the first insulating layers is disposed such that it crosses one of the inner and outer magnetic paths of the helical coil. At least a part of a margin of the second insulating layer overlaps with the conductive layer in the stacking direction, and the second insulating layer is in contact with the conductive layer in the overlap portion.

Thus, in one aspect, the magnetic flux density in the laminate is likely to be highest in the overlap portion with the conductive layer, and the highest-density magnetic flux passes through the second insulating layer inevitably, whereby the direct current superposition property can be uniformly improved.

The above object, another object, a structural characteristic, and an advantageous effect of certain inventive aspects will be apparent from the following description and attached drawings.

DETAILED DESCRIPTION OF CERTAIN INVENTIVE EMBODIMENTS

Figure 1:
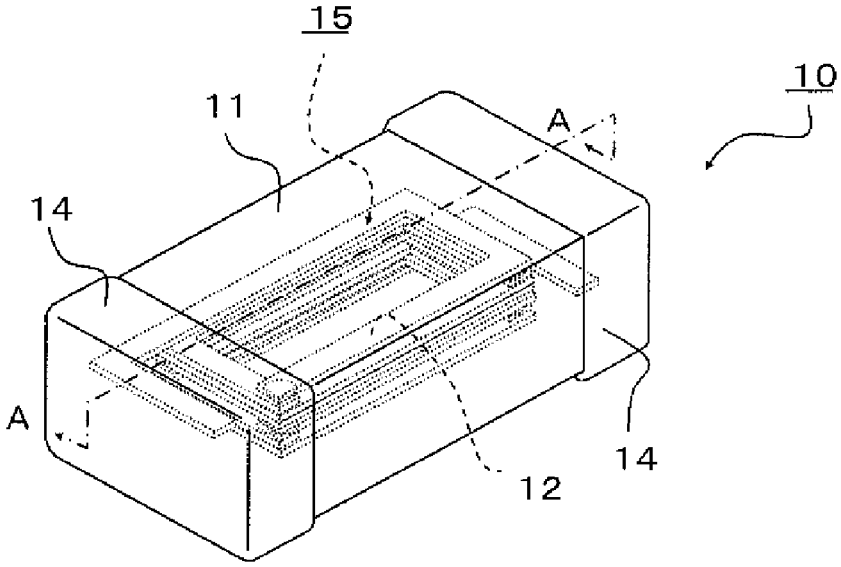
FIG. 1 is a perspective view showing an appearance of a multilayer inductor according to Example 1 of one embodiment with a part of the internal structure exposed.
Figure 3:
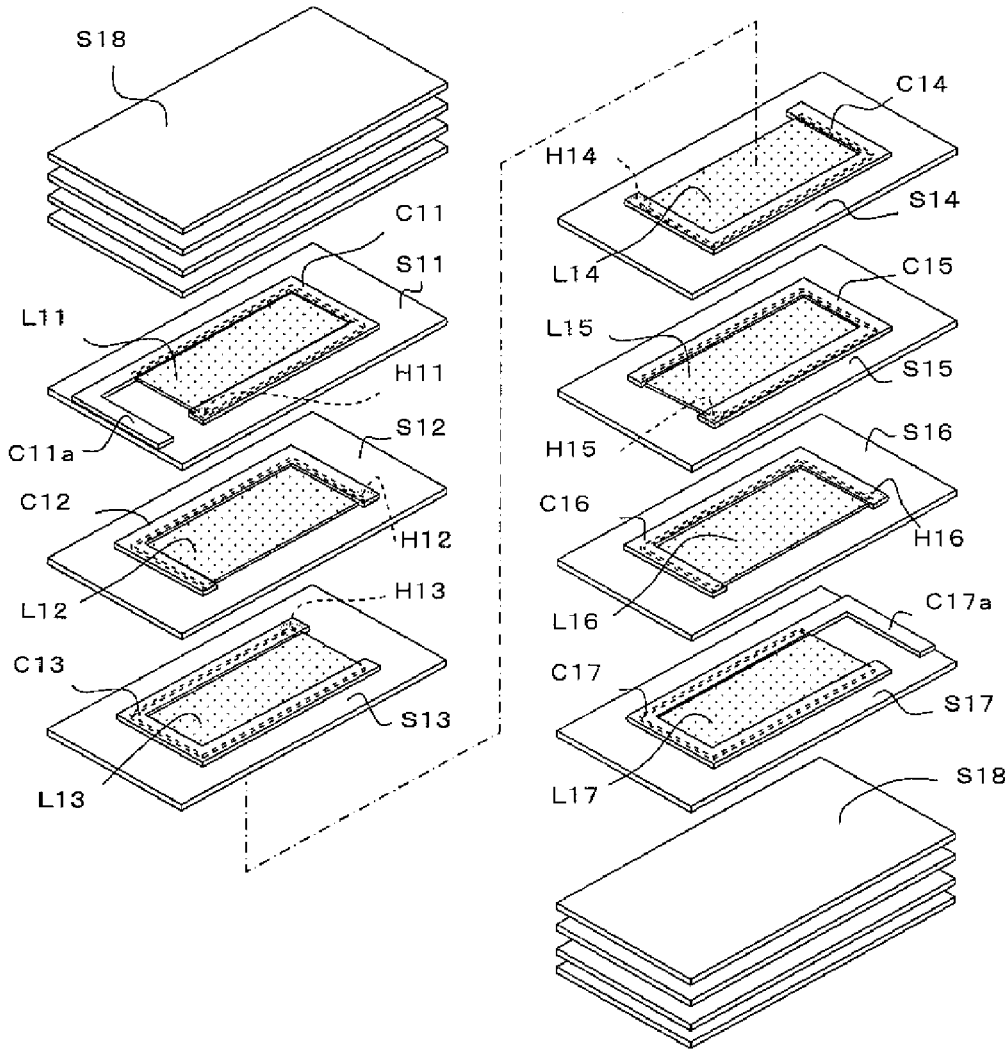
FIG. 3 is an exploded perspective view for explaining the internal structure of the multilayer inductor according to Example 1.
Figure 4:
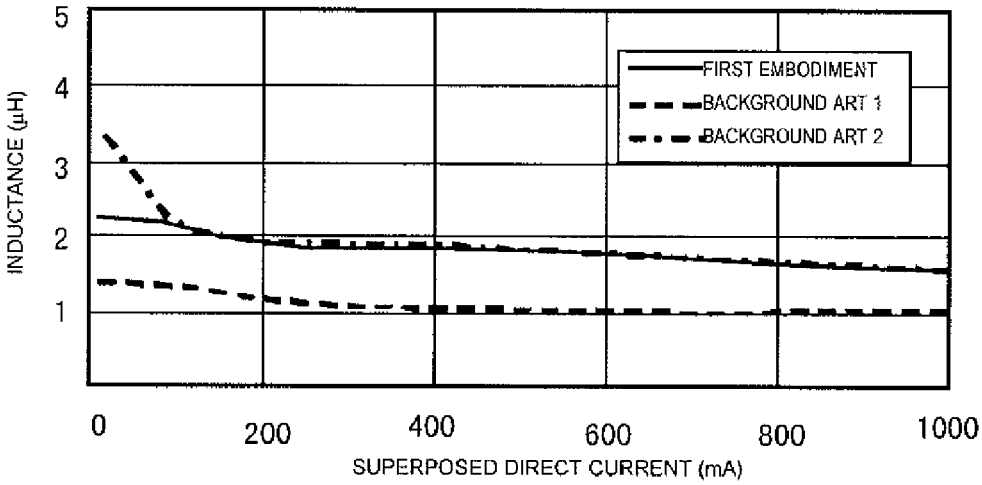
FIG. 4 is a graph showing results of measuring the direct current superposition property of the multilayer inductor according to Example 1.

A first embodiment of the multilayer inductor of the present invention will be described below with reference to FIGS. 1 to 4. FIG. 1 is a perspective view showing the entire appearance of the multilayer inductor of this embodiment with a part of the internal structure exposed, FIG. 2 is a cross-sectional view showing the multilayer inductor taken along A-A line of FIG. 1, FIG. 3 is an exploded perspective view showing the internal structure of the multilayer inductor of this embodiment, and FIG. 4 is a graph showing the direct current superposition property of the multilayer inductor of this embodiment.

Figure 2:
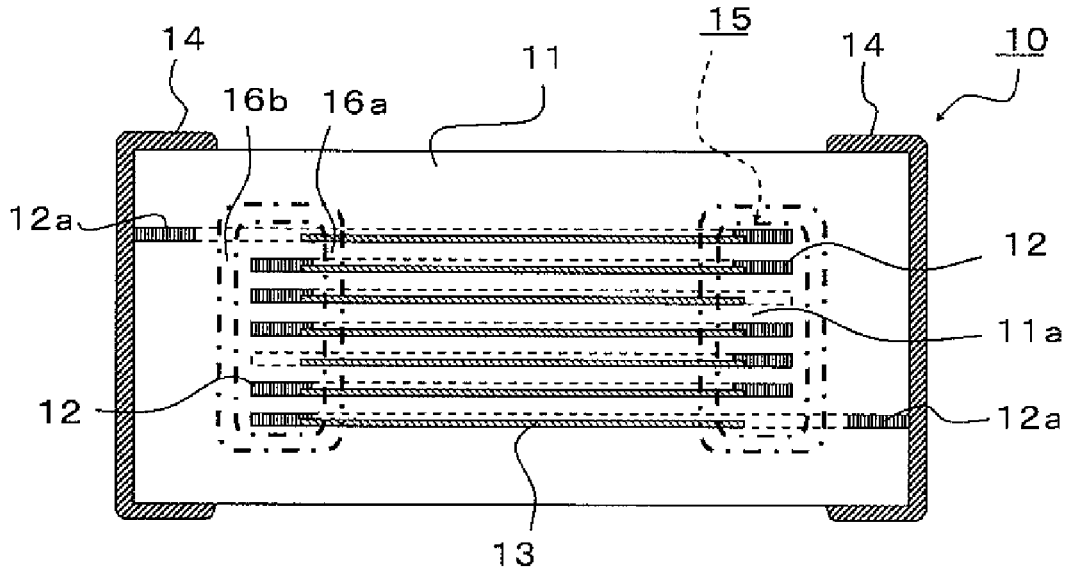
FIG. 2 is a cross-sectional view showing the internal structure of the multilayer inductor according to Example 1 taken along A-A line of FIG. 1.

In a multilayer inductor 10 shown in FIGS. 1 and 2, a plurality of first insulating layers 11*a* comprising a magnetic material and a plurality of conductive layers 12 are stacked, whereby a helical coil 15 is formed in a laminate 11.

Second insulating layers 13 comprise a magnetic or non-magnetic material, thereby having a magnetic permeability lower than those of the first insulating layers, and are disposed such that they cross an inner magnetic path 16*a* or an outer magnetic path 16*b* of the helical coil 15. A margin of the second insulating layer 13 overlaps and comes into contact with the conductive layer 12.

In the multilayer inductor 10, only one of a low-density magnetic flux at the center of the coil and a low-density magnetic flux at the outside of the coil passes through the second insulating layer 13 comprising the magnetic or non-magnetic material to have a low magnetic permeability. Further, the magnetic flux density in the laminate 11 is likely to be highest in the overlap portion of the second insulating layer 13 and the conductive layer 12, and the highest-density magnetic flux reliably passes through the second insulating layer 13, whereby the magnetic saturation can be uniformly prevented. Thus, the direct current superposition property can be reliably improved without greatly deteriorating the inductance value.

The magnetic material for the first insulating layers may be appropriately selected from materials mainly composed of Ni—Zn-based ferrites, Ni—Zn—Cu-based ferrites, etc. The material for the conductive layers may be appropriately selected from materials mainly composed of Ag, Ag—Pd alloys, etc. The material for the second insulating layers may be appropriately selected from materials mainly composed of insulating materials having no magnetism at ordinary temperature such as Cu—Zn-based ferrites and Zn-based ferrites, insulating materials of mixtures of glasses and $TiO_2$ powders, etc., the insulating materials having a magnetic permeability lower than those of the first insulating layers.

The multilayer inductor 10 is such that the first insulating layers 11*a* comprising the magnetic material and the conductive layers 12 are alternately stacked, burned, and connected, to form the helical coil 15 in the laminate 11. The multilayer inductor of the invention is not limited to the embodiment. The first insulating layers 11*a* may comprise a mixture of an epoxy resin, etc. with a powder of an Ni—Zn-based ferrite, an Ni—Zn—Cu-based ferrite, an Mn—Zn ferrite, or a magnetic metal material, etc., the second insulating layers 13 may comprise a mixture of an epoxy resin, etc. with an insulating material having no magnetism at ordinary temperature such as a Cu—Zn-based ferrite or a Zn-based ferrite, an insulating material containing a glass and a $TiO_2$ powder, or a powder of a filler, etc., the conductive layers 12 may comprise a material mainly composed of a resin and a powder of Ag or an Ag—Pd alloy, a foil of a metal such as Au or Cu, or a metal film, etc., and a resin composite type laminate may be formed by stacking and connecting the layers under heat and pressure.

A typical process of producing the multilayer inductor 10 will be described below. As shown in FIG. 3, a magnetic material powder for forming the first insulating layers is mixed with an organic binder such as polyvinyl acetate or ethyl cellulose, a solvent such as terpineol, a dispersant, etc. to prepare a high-magnetic permeability insulating material slurry, and the slurry is applied to a carrier film of PET (Polyethylene Terephthalate), etc. by a known method such as a doctor blade method or a gravure printing method, and the applied slurry is dried, whereby ceramic green sheets S11 to S18 are prepared respectively. Further, a conductive material powder for forming the conductive layers, a vehicle, and a solvent are mixed to prepare a conductive material paste, and an insulating material powder for forming the second insulating layers, an organic binder, and a solvent are mixed to prepare a low-magnetic permeability insulating material paste.

Through holes H11 to H16 are formed at predetermined positions in the above ceramic green sheets S11 to S16 by a known method such as punching press or laser light irradiation, and the low-magnetic permeability insulating material paste is applied to the ceramic green sheets S11 to S17 into a predetermined pattern by a known printing method such as a screen printing method, whereby second insulating material layers L11 to L17 are formed.

Then, the conductive material paste is applied to the ceramic green sheets S11 to S17 into a C-shaped pattern such as a ¾ turn or ½ turn pattern by a known printing method such as a screen printing method in the same manner as above, whereby conductive material layers C11 to C17 are formed such that they overlap with at least a part of the margins of the second insulating material layers L11 to L17, and the through holes H11 to H16 are filled with the conductive material paste to form through hole conductors.

The ceramic green sheets S11 to S17 are stacked in the predetermined order such that the conductive material layers C11 to C17 and the through hole conductors are connected to form a helical coil. A plurality of the ceramic green sheets S18, to which the low-magnetic permeability insulating material paste, the conductive material paste, etc. are not applied, are stacked on each sides of the ceramic green sheets S11 to S17, and are attached thereto under pressure. The resultant is subjected to a de-binder treatment at 400° C. to 600° C. for 1 to 3 hours, and burned at 800° C. to 1000° C. for 1 to 10 hours, to obtain the laminate 11.

Then, a printing type conductive material paste mainly containing a powder of a conductive material such as Ag or an Ag—Pd alloy, etc. or a thermosetting type conductive resin paste containing a powder of a conductive material such as Ag or an Ag—Pd alloy, etc. is applied to the ends of projecting portions 12*a* of the conductive layers 12 of the laminate 11 thus obtained by a known coating method such as a screen printing method, a dipping method, or a transfer method, and the applied paste is baked or thermally hardened at a certain temperature to form external electrodes 14, 14.

Further, a Cu plating, an Ni plating, an Sn plating, etc. may be formed on the external electrodes to improve soldering property, etc., if necessary.

EXAMPLES

Example 1

A multilayer inductor of Example 1 according to the above first embodiment will be described below with reference to FIGS. 1 to 4. First a process for producing the multilayer inductor 10 of Example 1 is described using FIG. 3.

An Ni—Zn—Cu-based ferrite mainly composed of $FeO_2$, CuO, ZnO, and NiO was calcined, crushed into a powder, and mixed with a polyvinyl acetate-based organic binder, a solvent, and a dispersant, to prepare a high-magnetic permeability insulating material slurry for forming first insulating layers 11*a*. The obtained slurry was applied to PET films by a doctor blade method, and then dried to prepare ceramic green sheets S11 to S18. Further, an Ag powder, a vehicle, and a solvent were mixed to prepare a conductive material paste for forming conductive layers 12, and a Zn-based ferrite powder was mixed with an organic binder and a solvent to prepare a low-magnetic permeability insulating material paste for forming second insulating layers.

Through holes H11 to H16 were formed at predetermined positions in the above ceramic green sheets S11 to S16 by punching press, and the low-magnetic permeability insulating material paste was applied to the ceramic green sheets S11 to S17 into a predetermined pattern by a screen printing method, whereby second insulating material layers L11 to L17 were formed.

Then, the conductive material paste was applied to the ceramic green sheets S11 to S17 into a ¾-turn C-shaped pattern by a screen printing method, whereby conductive material layers C11 to C17 were formed such that they overlapped with at least a part of the margins of the second insulating material layers L11 to L17, and the through holes H11 to H16 were filled with the conductive material to form through hole conductors.

The ceramic green sheets S11 to S17 were stacked in the predetermined order such that the conductive material layers C11 to C17 and the through hole conductors were connected to form a helical coil. A plurality of the ceramic green sheets S18, to which the low-magnetic permeability insulating material paste, the conductive material paste, etc. were not applied, were stacked on each sides of the ceramic green sheets S11 to S17, and were attached thereto under pressure. The resultant was subjected to a de-binder treatment at 500° C. for 1 hour, and burned at 900° C. for 5 hours, to obtain a laminate 11.

Then, a printing type conductive material paste mainly composed of an Ag powder was applied to the ends of projecting portions 12*a* of the conductive layers 12 of the laminate 11 thus obtained by a dipping method, and the applied paste was baked at 650° C. to form external electrodes 14, 14. Further, an Ni plating layer and an Sn plating layer were formed in this order on the external electrodes to produce the multilayer inductor 10, though the plating layers were not shown.

As shown in FIGS. 1 and 2, in thus-obtained multilayer inductor 10 according to Example 1, a plurality of the insulating layers 11*a* mainly composed of the Ni—Zn—Cu-based ferrite and a plurality of the ¾-turn C-shaped conductive layers 12 mainly composed of Ag are stacked, and the conductive layers 12 and the through hole conductors are connected to form the helical coil 15 in the laminate 11. The rectangular second insulating layers 13 mainly composed of the Zn-based ferrite, which have magnetic permeabilities lower than those of the first insulating layers 11*a*, are disposed such that they cross the inner magnetic path 16*a* of the helical coil 15, and the margins of the second insulating layers 13 overlap with the conductive layers 12 in the stacking direction and thus are covered with the conductive layers 12. In the multilayer inductor 10 according to Example 1, seven stack structures are arranged in the stacking direction of the laminate 11. In each overlap portion, three sides of the surface of the second insulating layer 13 are in contact with three strips of the ¾-turn C-shaped conductive layer 12 in the surface direction and the thickness direction.

Comparative Example 1

A multilayer inductor according to Comparative Example 1 was produced in the same manner as Example 1 except that the second insulating layers were not formed.

The direct current superposition properties of the multilayer inductors of Example 1 and Comparative Example 1 were measured.

In the case of the multilayer inductor of Comparative Example 1, the inductance value was rapidly reduced when the current bias reached about 70 mA, and the inductance value at 1 A was 1/50 of the initial inductance value. In contrast, in the case of the multilayer inductor 10 of Example 1, the inductance value was hardly reduced from the initial inductance value even when the current bias was increased to about 100 mA.

Further, multilayer inductors according to Background Arts 1 and 2 were produced in the same manner as the first embodiment except for the arrangement of the second insulating layers 13.

The direct current superposition properties of the multilayer inductors of the first embodiment and Background Arts 1 and 2 were measured, and the results are shown in FIG. 4. The transverse axis indicates the superposed direct current value of 0 to 1000 mA, and the ordinate axis indicates the inductance value of 0 to 5 μH. The dashed line indicates the measurement result of the multilayer inductor of JP-A-56-155516, and the inductance value was very low in the entire range of the applied superposed direct current, also the initial inductance value being low. The dashed-dotted line indicates the measurement result of the multilayer inductor of JP-A-56-155516, and the inductance value was rapidly reduced from the initial inductance value around 100 mA along with the increase of the superposed direct current value.

The continuous line indicates the measurement result of the multilayer inductor 10 of the first embodiment. Though the initial inductance value of the first embodiment was approximately intermediate between Background Arts 1 and 2, the change of the inductance value was small such that it was not rapidly reduced with the increase of the superposed direct current value as was different from the results of JP-A-56-155516 shown by the dashed-dotted line.

As described above, in Example 1 of one embodiment, the magnetic flux density in the laminate 11 of the multilayer inductor 10 is likely to be highest in the overlap portion of the second insulating layer 13 and the conductive layer 12, and the highest-density magnetic flux passes through the second insulating layer 13 inevitably. Thus, magnetic saturation is prevented when an electrical current is applied to the multilayer inductor 10, and the direct current superposition property can be uniformly improved.

Further, the margin of the second insulating layers 13 are in contact with the conductive layers 12 in the surface direction and the thickness direction as described above. Even when the second insulating layers are thinner, the layers are reliably brought into contact with each other, and the second insulating layers can uniformly reduce the passing of the magnetic flux. Thus, there can be provided such a multilayer inductor that the magnetic path of the coil is not completely divided and the initial inductance value is not greatly reduced.

The second insulating layers 13 are not exposed from the multilayer inductor 10, whereby the multilayer inductor 10 can be used as a closed magnetic path-type electronic unit with a small magnetic flux leakage.

Furthermore, in the multilayer inductor 10 of Example 1, a plurality of the second insulating layers 13 are arranged in the stacking direction of the laminate 11, whereby the properties are not largely changed under an electrical current, and the stability of the direct current superposition property can be further improved.

Example 2

A multilayer inductor of Example 2 according to this embodiment will be described below with reference to FIGS. 5 and 6.

Figure 5:
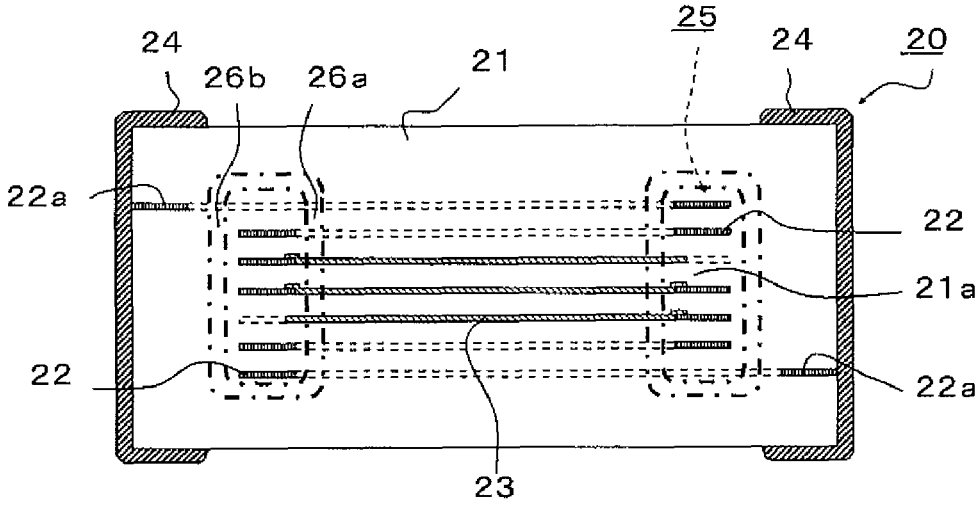
FIG. 5 is a cross-sectional view showing an internal structure of a multilayer inductor according to Example 2 of one embodiment.
Figure 6:
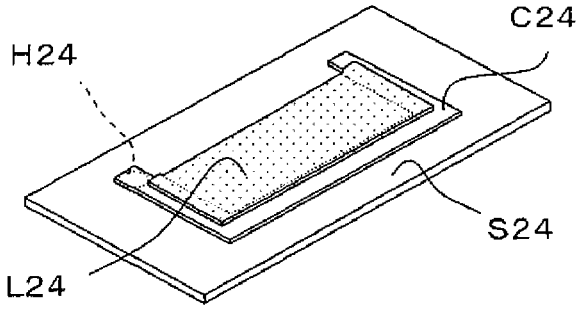
FIG. 6 is a perspective view showing an example of a process in Example 2.

FIG. 5 is a cross-sectional view showing an internal structure of a multilayer inductor 20 according to Example 2 of one embodiment, and FIG. 6 is a perspective view of a main portion for explaining an example of a process for producing the multilayer inductor 20 in Example 2.

As shown in FIG. 5, in the multilayer inductor 20 according to Example 2, a plurality of insulating layers 21*a* mainly composed of an Ni—Zn—Cu-based ferrite and a plurality of ¾-turn C-shaped conductive layers 22 mainly composed of Ag are stacked, and the conductive layers 22 and through hole conductors are connected to form a helical coil 25 in the laminate 21. Rectangular second insulating layers 23 mainly composed of a Zn-based ferrite, which have magnetic permeabilities lower than those of the first insulating layers 21*a*, are disposed such that they cross the inner magnetic path 26*a* of the helical coil 25 as with Example 1, and the margins of the second insulating layers 23 overlap with the conductive layers 22 in the stacking direction and thus cover the conductive layers 22. In the multilayer inductor 20 according to Example 2, three stack structures are arranged in the stacking direction of the laminate 21. In each overlap portion, three sides of the surface of the second insulating layer 23 are in contact with three strips of the ¾-turn C-shaped conductive layer 22 in the surface direction and the thickness direction.

A first difference between Examples 1 and 2 is such that the conductive layers 22 are covered from above with the margins of the second insulating layers 23 in Example 2. In the preparation of the laminate 21 for the multilayer inductor 20 of Example 2, a through hole H24 was formed in a ceramic green sheet S24 with a first insulating layer, a ¾-turn C-shaped conductive material layer C24 was formed on the ceramic green sheet S24, the through hole H24 was filled with a conductive material to form a through hole conductor, and a low-magnetic permeability insulating material layer L24 was formed by printing such that its margin overlapped on the conductive material layer C24, whereby the above structure was obtained. In view of increasing the inductance value of the multilayer inductor by using thinner second insulating layers, in a case where the thicknesses of the second insulating layers are smaller than those of the conductive layers, it is preferred that the conductive layers are placed on the margins of the second insulating layers as described in Example 1. In a case where the thicknesses of the second insulating layers are equal to or larger than those of the conductive layers, it is preferred that the margins of the second insulating layers are placed on the conductive layer to improve continuousness of the second insulating layers and the conductive layers as described in Example 2.

A second difference between Examples 1 and 2 is such that the second insulating layers 13 corresponding to all the conductive layers 12 other than the projecting portions 12*a* are formed in the helical coil 15 in Example 1, while only three second insulating layers are formed on three conductive layers 22 closer to the center of the pivot of the helical coil in Example 2. It is preferred that the second insulating layers are disposed at positions closer to the center of the pivot of the helical coil, at which the magnetic flux density is likely to be higher, from the viewpoint of producing a low load current type multilayer inductor with an excellent direct current superposition property and a high inductance value.

The other advantageous effects of the multilayer inductor of Example 2 are the same as those of Example 1.

Examples 3 and 4

Figure 7:
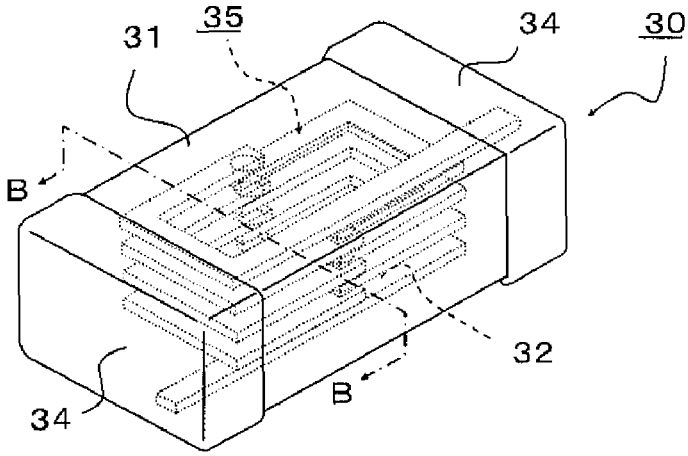
FIG. 7 is a perspective view showing an appearance of a multilayer inductor according to Example 3 of one embodiment with a part of the internal structure exposed.
Figure 8:
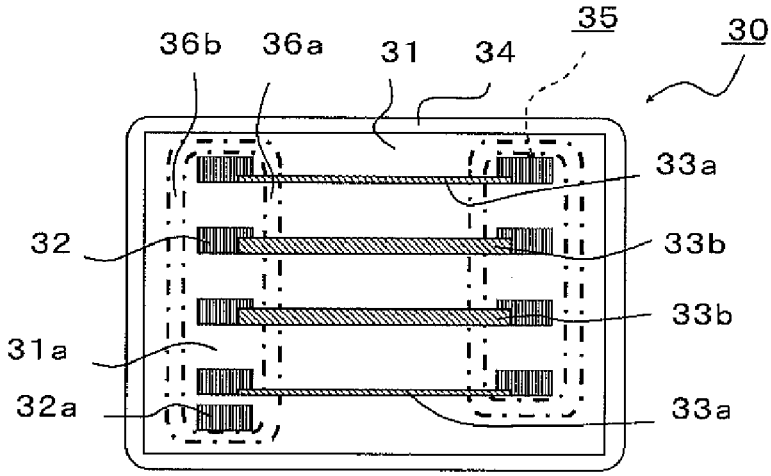
FIG. 8 is a cross-sectional view showing the internal structure of the multilayer inductor according to Example 3 taken along B-B line of FIG. 7.
Figure 10:
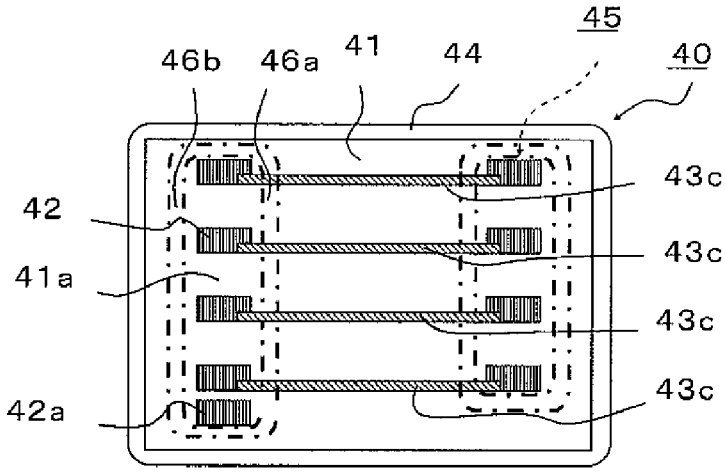
FIG. 10 is a cross-sectional view showing an internal structure of a multilayer inductor according to Example 4 of one embodiment.
Figure 11:
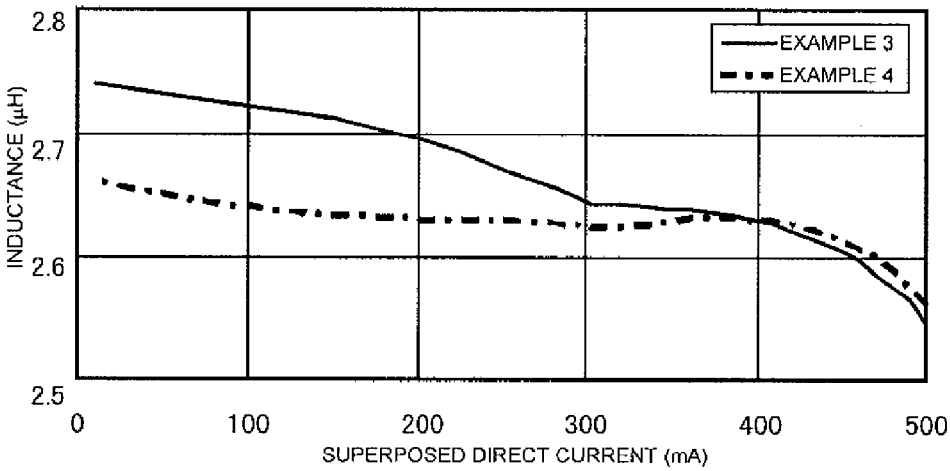
FIG. 11 is a graph showing results of measuring the direct current superposition properties of the multilayer inductors according to Examples 3 and 4.

Multilayer inductors of Examples 3 and 4 according to a second embodiment of the invention will be described below with reference to FIGS. 7 to 11. FIG. 7 is a perspective view showing the whole appearance of the multilayer inductor of Example 3 according to this embodiment with a part of the internal structure exposed, FIG. 8 is a cross-sectional view showing the multilayer inductor taken along B-B line of FIG. 7, FIG. 9 is an exploded perspective view showing the internal structure of the multilayer inductor of Example 3, FIG. 10 is a cross-sectional view showing the internal structure of the multilayer inductor of Example 4 according to this embodiment of the invention, and FIG. 11 is a graph showing results of measuring the direct current superposition properties of the multilayer inductors of Examples 3 and 4.

Figure 9:
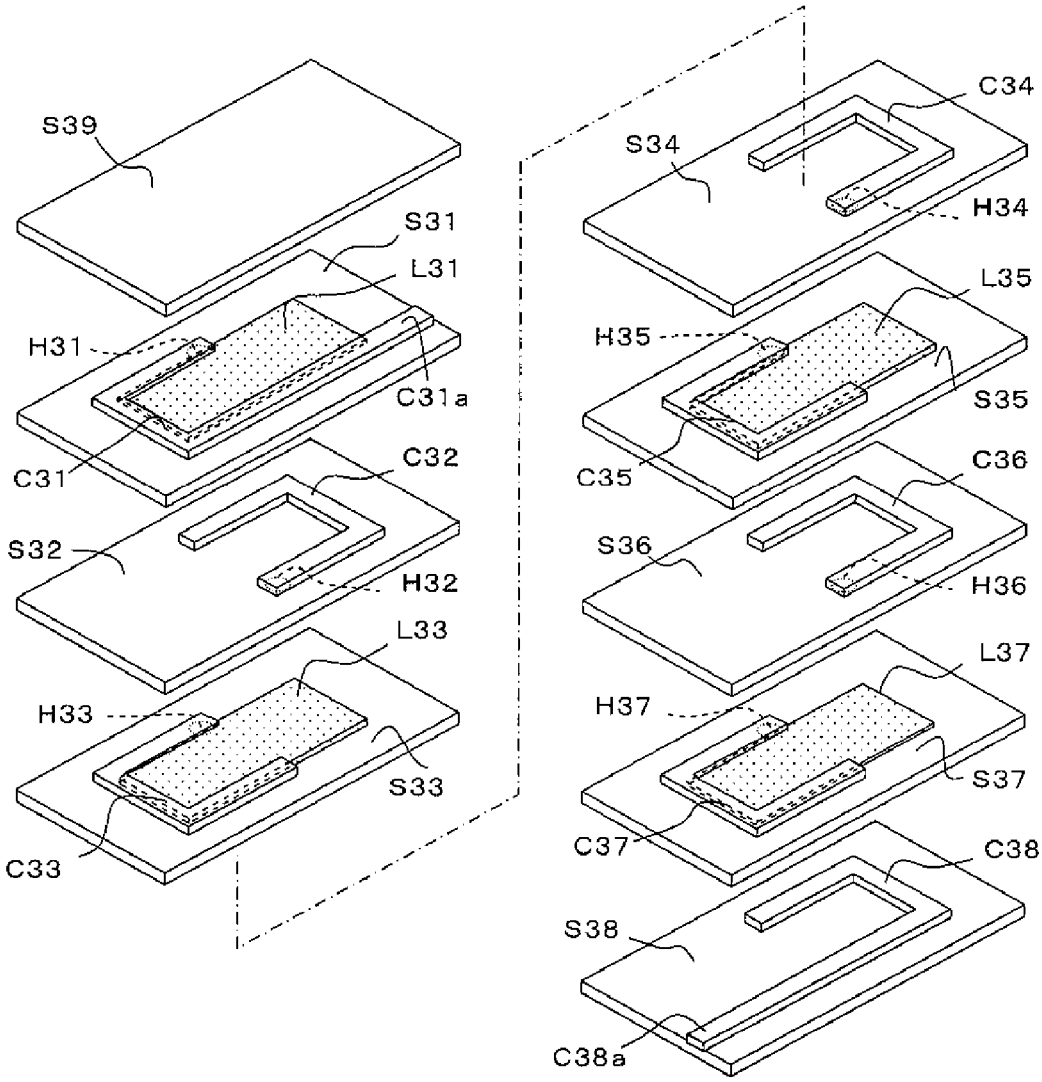
FIG. 9 is an exploded perspective view for explaining the internal structure of the multilayer inductor according to Example 3.

First a process for producing the multilayer inductor 30 of Example 3 is described using FIG. 9.

An Ni—Zn—Cu-based ferrite powder was mixed with a polyvinyl acetate-based organic binder, a solvent, and a dispersant, to prepare a high-magnetic permeability insulating material slurry for forming first insulating layers 31*a*. The obtained slurry was applied to PET films by a doctor blade method, and then dried to prepare ceramic green sheets S31 to S39. Further, an Ag powder, a vehicle, and a solvent were mixed to prepare a conductive material paste for forming conductive layers 32, and a Zn-based ferrite powder was mixed with an organic binder and a solvent to prepare a low-magnetic permeability insulating material paste for forming second insulating layers 33.

Through holes H31 to H37 were formed at predetermined positions in the above ceramic green sheets S31 to S37 by punching press, and the low-magnetic permeability insulating material paste was applied to the ceramic green sheets S31, S33, S35, and S37 into a predetermined pattern by a screen printing method, whereby second insulating material layers L31, L33, L35, and L37 were formed. The low-magnetic permeability insulating material paste was printed four times on the ceramic green sheets S33 and S35, so that the second insulating material layers L33 and L35 were four times as thick as the second insulating material layers L31 and L37 formed on the ceramic green sheets S31 and S37.

Then, the conductive material paste was applied to the ceramic green sheets S31 to S38 into a ½-turn C-shaped pattern by a screen printing method, whereby conductive material layers C31 to C38 were formed such that they overlapped with at least a part of the margins of the second insulating material layers L31, L33, L35, and L37, and the through holes H31 to H37 were filled with the conductive material paste to form through hole conductors.

The ceramic green sheets S31 to S38 were stacked in the predetermined order such that the conductive material layers C31 to C38 and the through hole conductors were connected to form a helical coil. The ceramic green sheet S39, to which the low-magnetic permeability insulating material paste, the conductive material paste, etc. were not applied, was stacked on the ceramic green sheets S31 to S38, and were attached thereto under pressure. The resultant was subjected to a de-binder treatment at 500° C. for 1 hour, and burned at 900° C. for 5 hours, to obtain the laminate 31.

Then, a printing type conductive material paste mainly composed of an Ag powder was applied to the ends of projecting portions 32*a* of the conductive layers 32 of thus-obtained laminate 31 by a dipping method, and the applied paste was baked at 650° C. to form external electrodes 34, 34. Further, an Ni plating layer and an Sn plating layer were formed in this order on the external electrodes to produce the multilayer inductor 30, though the plating layers were not shown.

As shown in FIGS. 7 and 8, in thus-obtained multilayer inductor 30 according to Example 3, a plurality of the insulating layers 31*a* mainly composed of the Ni—Zn—Cu-based ferrite and a plurality of the ½-turn C-shaped conductive layers 32 mainly composed of Ag are stacked, and the conductive layers 32 and the through hole conductors are connected to form the helical coil 35 in the laminate 31. The rectangular second insulating layers 33 mainly composed of the Zn-based ferrite, which have magnetic permeabilities lower than those of the first insulating layers 31*a*, are disposed in the same manner as Example 1 such that they cross the inner magnetic path 36*a* of the helical coil 35, and the margins of the second insulating layers 33 overlap with the conductive layers 32 in the stacking direction and thus are covered with the conductive layers 32. In the multilayer inductor 30 according to Example 3, four stack structures are arranged in the stacking direction of the laminate 31. In each overlap portion, three sides of the surface of the second insulating layer 33 are in contact with three strips of the ½-turn C-shaped conductive layer 32 in the surface direction and the thickness direction.

Further, among the four second insulating layers 33 formed in Example 3, the second insulating layers 33*b* closer to the center of the pivot of the helical coil 35 have a thickness of 4 μm, and the second insulating layers farther from the center of the pivot have a thickness of 1 μm. Thus, the second insulating layers 33*b* closer to the center of the pivot of the helical coil 35 are thicker than the second insulating layers farther from the center of the pivot.

A process for producing the multilayer inductor 40 of Example 4 is described below.

An Ni—Zn—Cu-based ferrite powder was mixed with a polyvinyl acetate-based organic binder, a solvent, and a dispersant in the same manner as Example 3, to prepare a high-magnetic permeability insulating material slurry for forming first insulating layers 41*a*. The obtained slurry was applied to PET films by a doctor blade method, and then dried to prepare nine ceramic green sheets. Further, an Ag powder, a vehicle, and a solvent were mixed to prepare a conductive material paste for forming conductive layers 42, and a Zn-based ferrite powder was mixed with an organic binder and a solvent to prepare a low-magnetic permeability insulating material paste for forming second insulating layers 43.

Through holes were formed at predetermined positions in seven of the ceramic green sheets obtained above by punching press, and the low-magnetic permeability insulating material paste was applied to four of the ceramic green sheets into a predetermined pattern by a screen printing method, to form second insulating material layers 2.5 times as thick as the second insulating material layers L31 and L37 of Example 3.

Then, the conductive material paste was applied to the ceramic green sheets into a ½-turn C-shaped pattern by a screen printing method in the same manner as Example 3, whereby conductive material layers were formed such that they overlapped with at least a part of the margins of the second insulating material layers, and the through holes were filled with the conductive material paste to form through hole conductors.

The ceramic green sheets obtained above were stacked in the predetermined order such that the conductive material layers and the through hole conductors were connected to form a helical coil. One ceramic green sheet, to which the low-magnetic permeability insulating material paste, the conductive material paste, etc. were not applied, was stacked on the ceramic green sheets, and were attached thereto under pressure. The resultant was subjected to a de-binder treatment at 500° C. for 1 hour, and burned at 900° C. for 5 hours, to obtain the laminate 41.

Then, a printing type conductive material paste mainly composed of an Ag powder was applied to the ends of projecting portions 42*a* of the conductive layers 42 of thus-obtained laminate 41 by a dipping method, and the applied paste was baked at 650° C. to form external electrodes 44, 44. Further, an Ni plating layer and an Sn plating layer were formed in this order on the external electrodes to produce the multilayer inductor 40, though the plating layers were not shown.

As shown in FIG. 10, in thus-obtained multilayer inductor 40 according to Example 4, a plurality of the insulating layers 41*a* mainly composed of the Ni—Zn—Cu-based ferrite and a plurality of the ½-turn C-shaped conductive layers 42 mainly composed of Ag are stacked, and the conductive layers 42 and the through hole conductors are connected to form the helical coil 45 in the laminate 41. The rectangular second insulating layers 43 mainly composed of the Zn-based ferrite, which have magnetic permeabilities lower than those of the first insulating layers 41*a*, are disposed in the same manner as Example 1 such that they cross the inner magnetic path 46*a* of the helical coil 45, and the margins of the second insulating layers 43 overlap with the conductive layers 42 in the stacking direction and thus are covered with the conductive layers 42. In the multilayer inductor 40 according to Example 4, four stack structures are arranged in the stacking direction of the laminate 41 in the same manner as Example 3. In each overlap portion, three sides of the surface of the second insulating layer 43 are in contact with three strips of the ½-turn C-shaped conductive layer 42 in the surface direction and the thickness direction.

Further, in Example 4, the four second insulating layers 43*c* have a thickness of 2.5 μm, and thus the second insulating layers closer to the center of the pivot of the helical coil 45 are as thick as the second insulating layers farther from the center of the pivot.

The direct current superposition properties of the multilayer inductors of Examples 3 and 4 were measured, and the results are shown in FIG. 11. The transverse axis indicates the superposed direct current value (mA), and the ordinate axis indicates the inductance value (μH). The continuous line indicates the measurement result of the multilayer inductor 30 of Example 3, and the dashed-dotted line indicates that of Example 4.

As shown in FIG. 11, the second insulating layers 33*b* closer to the center of the pivot of the helical coil 35 were thicker than the second insulating layers farther from the center in the multilayer inductor 30 of Example 3, whereby the multilayer inductor 30 was more excellent in the inductance value in a load current range of 400 mA or less as compared with the multilayer inductor 40 of Example 4 having the four second insulating layers with the same thicknesses.

As described above, in Example 3, magnetic saturation can be effectively prevented from being caused by an applied electrical current at the center of the coil, at which the magnetic flux density is likely to be higher. Thus, the resultant multilayer inductor has a higher inductance value because the magnetic flux density is uniform in the coil under a load current.

The other advantageous effects of the multilayer inductors of Examples 3 and 4 are the same as those of Examples 1 and 2.

Example 5

Figure 12:
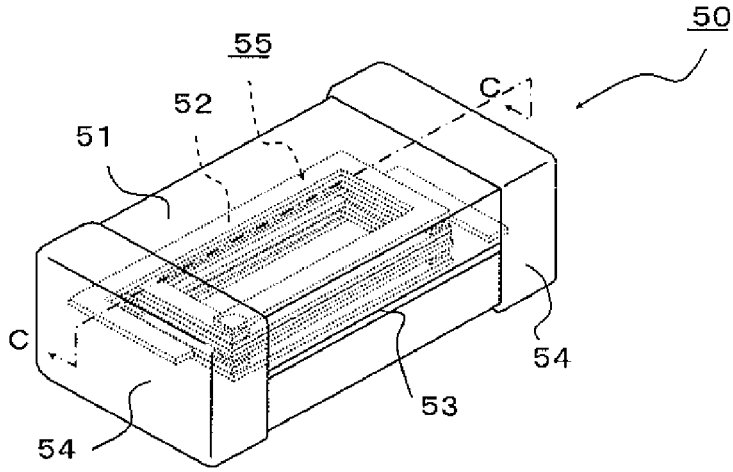
FIG. 12 is a perspective view showing an appearance of a multilayer inductor according to Example 5 of one embodiment with a part of the internal structure exposed.
Figure 13:
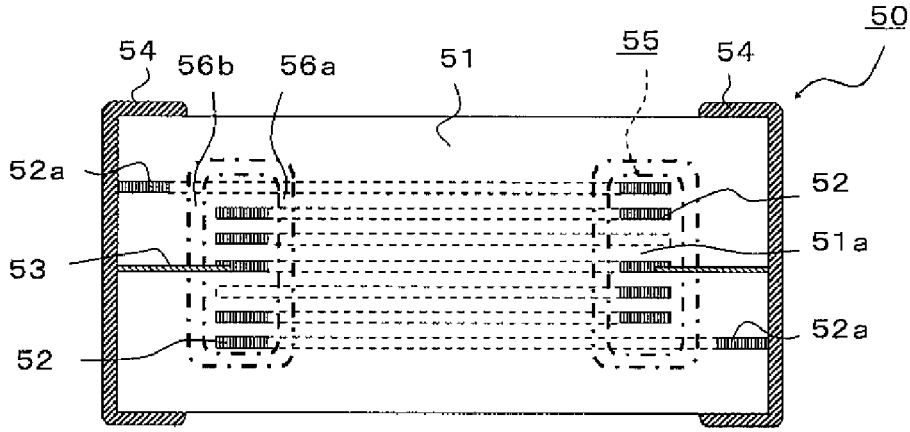
FIG. 13 is a cross-sectional view showing the internal structure of the multilayer inductor according to Example 5 taken along C-C line of FIG. 12.

A multilayer inductor of Example 5 according to a third embodiment of the invention will be described below with reference to FIGS. 12 to 15. FIG. 12 is a perspective view showing the whole appearance of the multilayer inductor according to Example 5 with a part of the internal structure exposed, FIG. 13 is a cross-sectional view showing the multilayer inductor taken along C-C line of FIG. 12, FIG. 14 is an exploded perspective view showing the internal structure of the multilayer inductor of Example 5, and FIG. 15 is a graph showing results of measuring the direct current superposition property of the multilayer inductor of Example 5.

Figure 14:
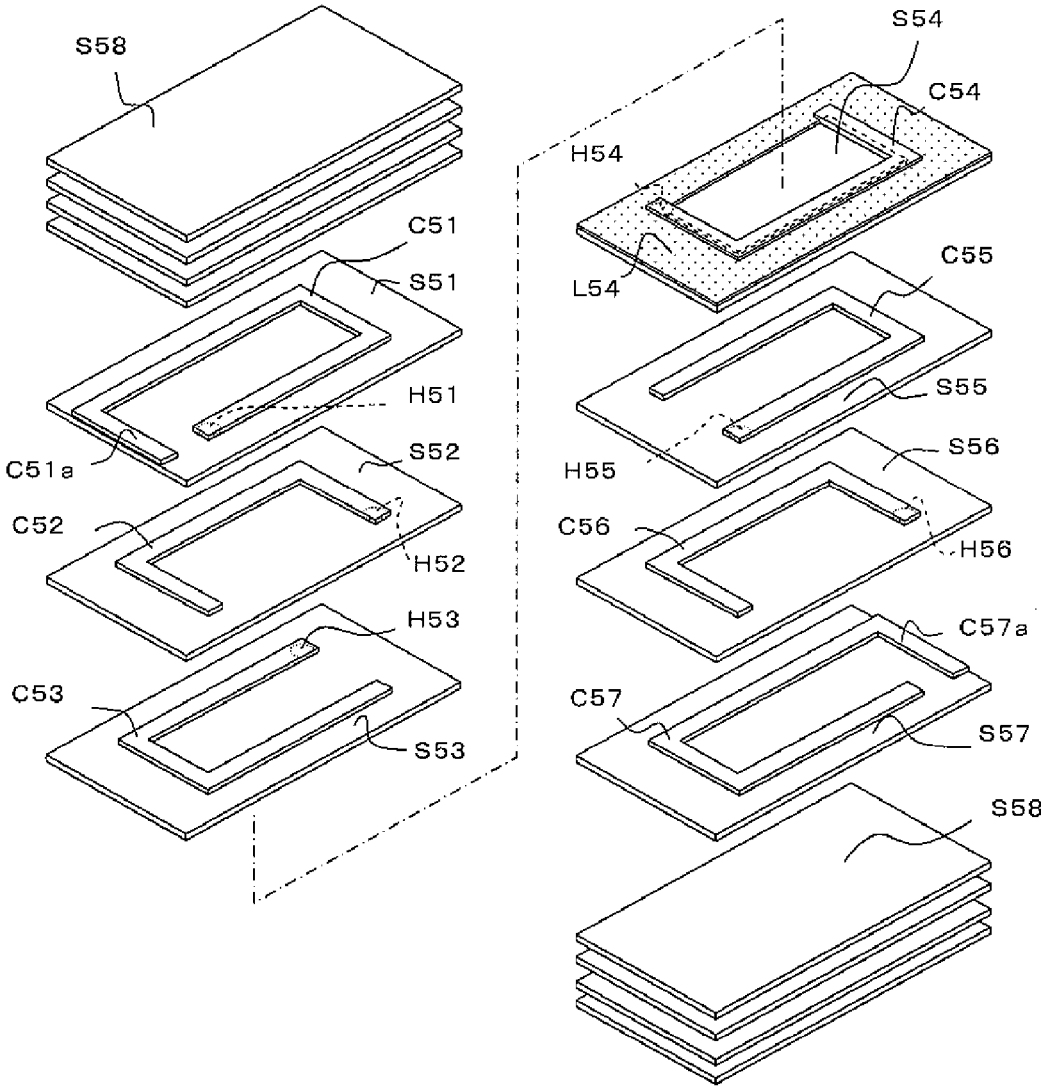
FIG. 14 is an exploded perspective view for explaining the internal structure of the multilayer inductor according to Example 5.
Figure 15:
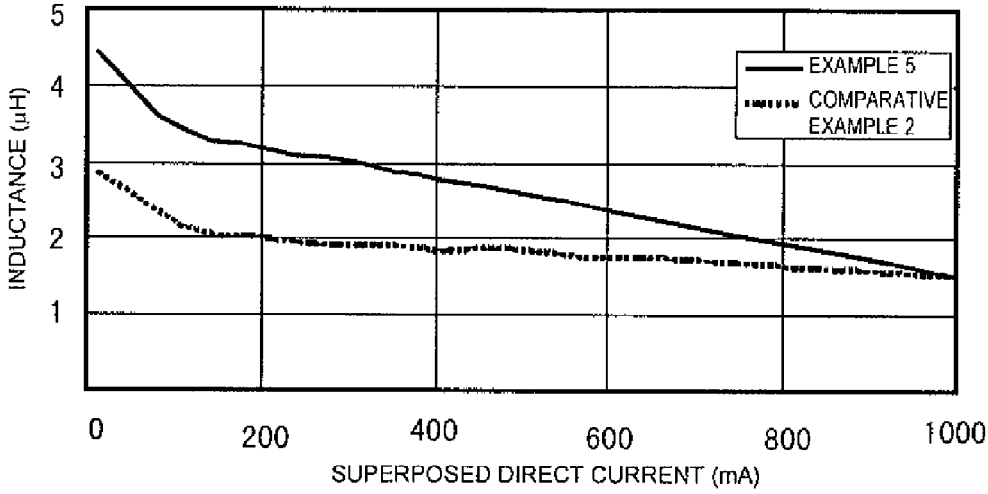
FIG. 15 is a graph showing results of measuring the direct current superposition property of the multilayer inductor according to Example 5.

First a process for producing the multilayer inductor 50 of Example 5 is described using FIG. 14.

An Ni—Zn—Cu-based ferrite mainly composed of $FeO_2$, CuO, ZnO, and NiO was calcined, crushed into a powder, and mixed with an ethyl cellulose-based organic binder and terpineol, to prepare a high-magnetic permeability insulating material slurry for forming first insulating layers 51*a*. The obtained slurry was applied to PET films by a doctor blade method, and then dried to prepare ceramic green sheets S51 to S58. Further, an Ag powder, a vehicle, and a solvent were mixed to prepare a conductive material paste for forming conductive layers 52, and a Cu—Zn-based ferrite powder mainly composed of $FeO_2$, CuO, and ZnO was mixed with an organic binder and a solvent to prepare a low-magnetic permeability insulating material paste for forming a second insulating layer.

Through holes H51 to H56 were formed at predetermined positions in the above ceramic green sheets S51 to S56 by punching press, and the low-magnetic permeability insulating material paste was applied to the ceramic green sheet S54 into a predetermined pattern by a screen printing method, whereby a second insulating material layer L54 was formed.

Then, the conductive material paste was applied to the ceramic green sheets S51 to S57 into a ¾-turn C-shaped pattern by a screen printing method, whereby conductive material layers C51 to C57 were formed so as to overlap with at least a part of the margin of the second insulating material layer L54, and such that the through holes H51 to H56 were filled with the conductive material paste to form through hole conductors.

The ceramic green sheets S51 to S57 obtained above were stacked in the predetermined order such that the conductive material layers C51 to C57 and the through hole conductors were connected to form a helical coil. A plurality of the ceramic green sheets S58, to which the low-magnetic permeability insulating material paste, the conductive material paste, etc. were not applied, were stacked on each sides of the ceramic green sheets S51 to S57, and were attached thereto under pressure. The resultant was subjected to a de-binder treatment at 500° C. for 1 hour, and burned at 900° C. for 5 hours, to obtain a laminate 51.

Then, a printing type conductive material paste mainly composed of an Ag powder was applied to the ends of projecting portions 52*a* of the conductive layers 52 of thus-obtained laminate 51 by a dipping method, and the applied paste was baked at 650° C. to form external electrodes 54, 54. Further, an Ni plating layer and an Sn plating layer were formed in this order on the external electrodes to produce the multilayer inductor 50, though the plating layers were not shown.

As shown in FIGS. 12 and 13, in thus-obtained multilayer inductor 50 according to Example 5, a plurality of the insulating layers 51*a* mainly composed of the Ni—Zn—Cu-based ferrite and a plurality of the ¾-turn C-shaped conductive layers 52 mainly composed of Ag are stacked, and the conductive layers 52 and the through hole conductors are connected to form a helical coil 55 in the laminate 51. The frame-shaped second insulating layer 53 mainly composed of the Cu—Zn-based ferrite, which has a magnetic permeability lower than those of the first insulating layers 51*a*, is disposed such that it crosses the outer magnetic path 56*b* of the helical coil 55, and the margin of the second insulating layer 53 overlaps with the conductive layer 52 in the stacking direction and thus the inner peripheral margin of the surface of the second insulating layer 53 is covered with the conductive layer 52. In the multilayer inductor 50 according to Example 5, one stack structure is disposed in the stacking direction of the laminate 51. In the overlap portion, three sides of the inner peripheral margin of the surface of the second insulating layer 53 are in contact with three strips of the ¾-turn C-shaped conductive layer 52 in the surface direction and the thickness direction.

Example 5 is different from Examples 1 to 4 in that the second insulating layer has a frame shape and crosses the outer magnetic path of the helical coil 55 in Example 5, while the second insulating layers 13, 23, 33, and 43 cross the inner magnetic paths of the helical coils 15, 25, 35, and 45 in Examples 1 to 4.

Comparative Example 2

A multilayer inductor of Comparative Example 2 according to JP-A-11-97245 was produced in the same manner as Example 5 except that a second insulating layer was formed inside conductive layers such that the layers were not overlapped.

The direct current superposition properties of the multilayer inductor 50 of Example 5 and the multilayer inductor of Comparative Example 2 were measured, and the results are shown in FIG. 15. The transverse axis indicates the superposed direct current value (mA), and the ordinate axis indicates the inductance value (μH). The continuous line indicates the measurement result of the multilayer inductor 50 of Example 5, and the dotted line indicates that of Comparative Example 2. As shown in FIG. 15, the multilayer inductor 50 of Example 5 was more excellent in the inductance value than Comparative Example 2 over a load current range from the initial to 1A.

As described above, in Example 5, the second insulating layer crosses the outer magnetic path 56*b* of the helical coil 55. Thus, a large magnetic path area can be obtained inside the helical coil 55, whereby a high inductance value can be achieved and the winding number of the coil 55 may be smaller to achieve a certain inductance value. Such a structure is particularly suitable for low load current type multilayer inductors.

Example 6

A multilayer inductor of Example 6 according to the third embodiment of the invention will be described below with reference to FIG. 16.

Figure 16:
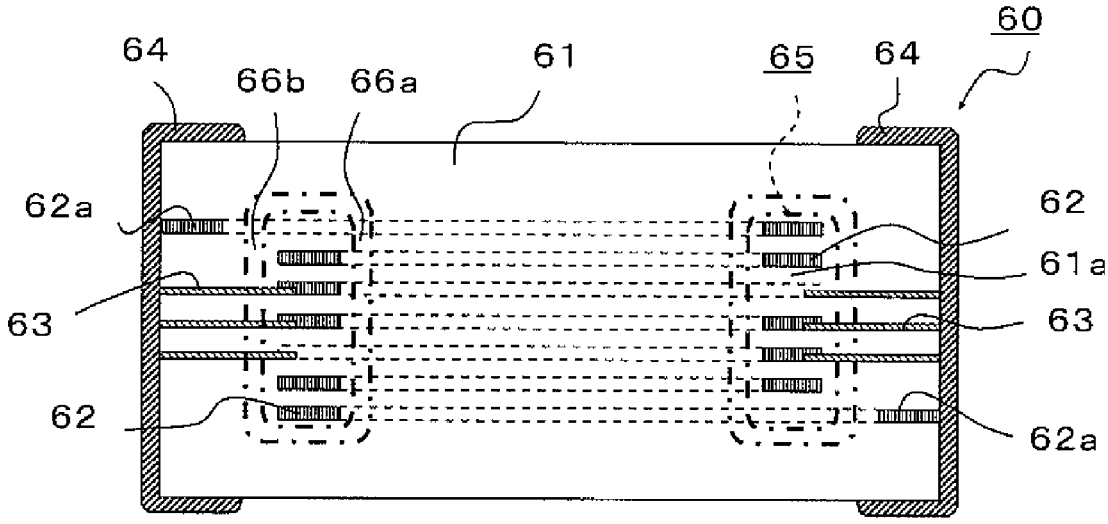
FIG. 16 is a cross-sectional view showing an internal structure of a multilayer inductor according to Example 6 of one embodiment.
Figure 17:
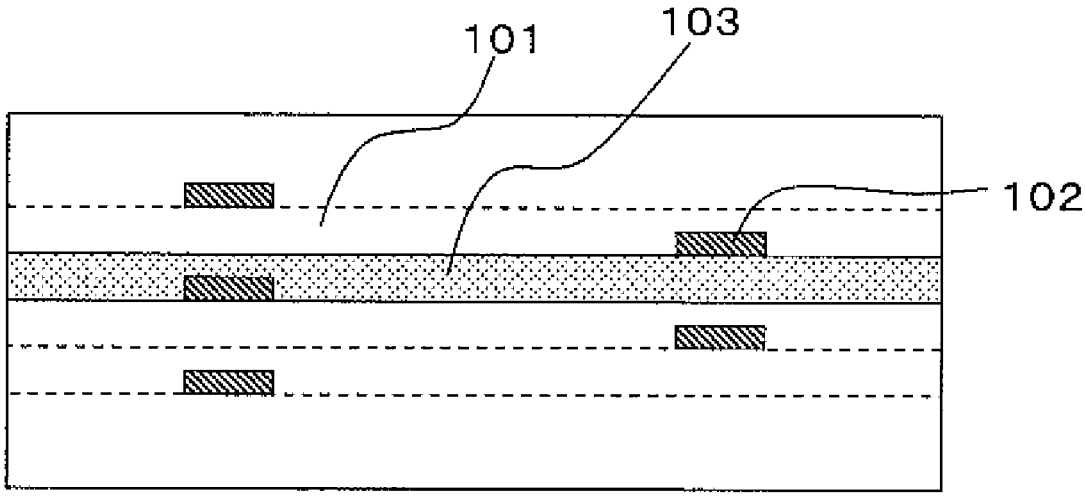
FIG. 17 is a view showing an inductor according to JP-A-56-155516.
Figure 18:
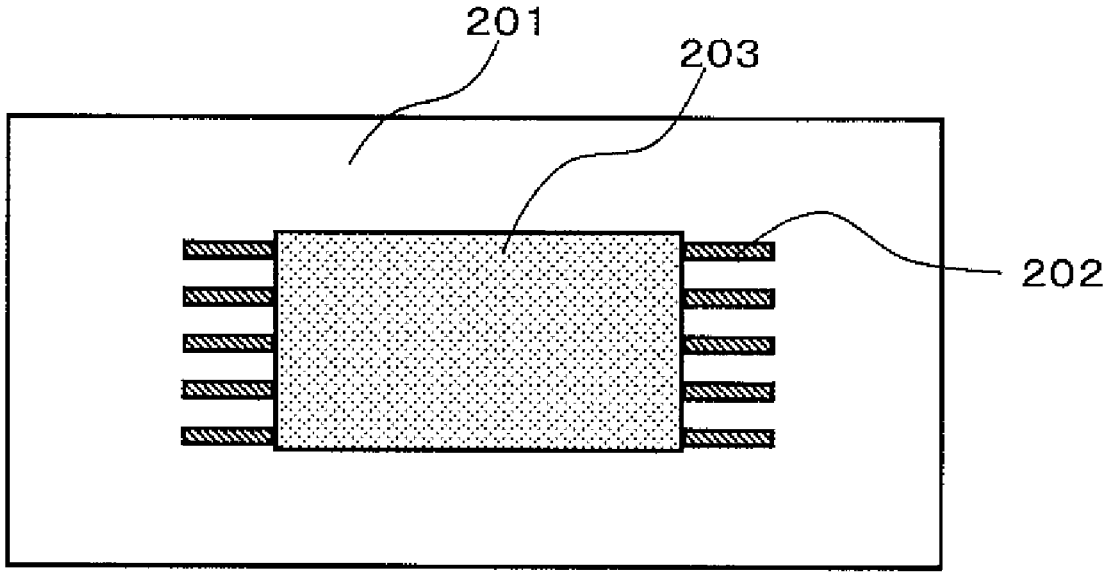
PRIOR ART Fig. 18
FIG. 18 is a view showing an inductor according to JP-A-11-97245.

FIG. 16 is a cross-sectional view showing the internal structure of the multilayer inductor 60 of Example 6, which is an example of the multilayer inductor according to the third embodiment of the invention.

As shown in FIG. 16, in the multilayer inductor 60 of according to Example 6, a plurality of insulating layers 61*a* mainly composed of the Ni—Zn—Cu-based ferrite and a plurality of the ¾-turn C-shaped conductive layers 62 mainly composed of Ag are stacked, and the conductive layers 62 and through hole conductors are connected to form a helical coil 65 in a laminate 61. Frame-shaped second insulating layers 63 mainly composed of a Cu—Zn-based ferrite, which have magnetic permeabilities lower than those of the first insulating layers 61*a*, are disposed in the same manner as Example 5 such that they cross the outer magnetic path 66*b* of the helical coil 65, and the inner peripheral margins of the surface of the second insulating layers 63 overlap with the conductive layers 62 in the stacking direction and thus are covered with the conductive layers 62. In the multilayer inductor 60 according to Example 6, three stack structures are disposed in the stacking direction of the laminate 61. In each overlap portion, three sides of the inner peripheral margin of the surface of the second insulating layer 63 are in contact with three strips of the ¾-turn C-shaped conductive layer 62 in the surface direction and the thickness direction.

Example 6 is different from Example 5 in that the three second insulating layers 63 are disposed on the three conductive layers 62 closer to the center of the pivot of the helical coil 65 in Example 6, while the second insulating layer 53 is disposed on one conductive layer 52 closer to the center of the pivot of the helical coil 55 in Example 5.

Thus, in Example 6, the properties are not largely changed under an electrical current, and the stability of the direct current superposition property can be further improved, as with Examples 1 to 4.

The multilayer inductors of Examples 1 to 6 contain the laminates prepared by burning and connecting magnetic ceramic materials, though the invention is not limited thereto.

As described above, a resin composite type laminate may be used for the multilayer inductor. The multilayer inductor can be used for various known electronics devices.

Thus, the multilayer inductor can be excellent in the direct current superposition property and inductance value.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A multilayer inductor comprising:

a laminate comprising a plurality of first insulating layers and a plurality of strip-shaped conductive layers formed thereon, and the conductive layers being connected to form a helical coil; and at least a second insulating layer having a magnetic permeability lower than those of the first insulating layers, the second insulating layer being disposed to cross one of an inner magnetic path and an outer magnetic path of the helical coil, wherein at least a part of the second insulating layer overlaps with the conductive layer in the stacking direction, and the second insulating layer is in contact with the conductive layer in the overlap portion.

2. A multilayer inductor according to claim 1, wherein the second insulating layer is in contact with the conductive layer in the surface direction and the thickness direction.

3. A multilayer inductor according to claim 1, wherein the second insulating layer crosses the inner magnetic path of the helical coil.

4. A multilayer inductor according to claim 1, wherein at least a plurality of the second insulating layers are arranged in the stacking direction of the laminate.

5. A multilayer inductor according to claim 4, wherein one of the second insulating layers closer to the center of the pivot of the helical coil is thicker than another of the second insulating layers farther from the center of the pivot.

6. A multilayer inductor according to claim 1, wherein the second insulating layer crosses the outer magnetic path of the helical coil.

7. A multilayer inductor according to claim 1, wherein the first insulating layers comprise a magnetic material.

8. A multilayer inductor according to claim 1, wherein the first insulating layers comprise either Ni—Zn-based ferrites or Ni—Zn—Cu-based ferrites.

9. The multilayer inductor according to claim 1, wherein the second insulating layer comprises at least one from the group of Cu—Zn-based ferrites, Zn-based ferrites, and mixtures of glasses and $TiO_2$ powders.

* * * * *